US007990354B2

(12) United States Patent
Chang et al.

(10) Patent No.: US 7,990,354 B2
(45) Date of Patent: Aug. 2, 2011

(54) LIQUID CRYSTAL DISPLAY HAVING GRADATION VOLTAGE ADJUSTING CIRCUIT AND DRIVING METHOD THEREOF

(75) Inventors: Chih-Sheng Chang, Miao-Li (TW); Chueh-Ju Chen, Miao-Li (TW)

(73) Assignee: Chimei Corporation, Miao-Li County (TW)

( * ) Notice: Subject to any disclaimer, the term of this patent is extended or adjusted under 35 U.S.C. 154(b) by 842 days.

(21) Appl. No.: 12/069,922

(22) Filed: Feb. 12, 2008

(65) Prior Publication Data

US 2008/0191983 A1 Aug. 14, 2008

(30) Foreign Application Priority Data

Feb. 12, 2007 (TW) ..... 96104972 A

(51) Int. Cl.
*G09G 3/38* (2006.01)

(52) U.S. Cl. ..... 345/89

(58) Field of Classification Search ..... 345/87, 345/690, 89

See application file for complete search history.

(56) References Cited

U.S. PATENT DOCUMENTS

| | | | | |
|---|---|---|---|---|
| 6,771,243 | B2 | 8/2004 | Hirohata | |
| 7,505,020 | B2 | 3/2009 | Yamamoto et al. | |
| 2004/0196274 | A1 * | 10/2004 | Song et al. | 345/204 |
| 2005/0093803 | A1 * | 5/2005 | Cheon et al. | 345/92 |
| 2006/0115178 | A1 * | 6/2006 | Fan et al. | 382/275 |

FOREIGN PATENT DOCUMENTS

CN 1591533 A 3/2005

* cited by examiner

*Primary Examiner* — Chanh Nguyen
*Assistant Examiner* — John Kirkpatrick
(74) *Attorney, Agent, or Firm* — Wei Te Chung

(57) ABSTRACT

An exemplary LCD (200) includes gate lines (23), data lines (24); a gradation voltage adjusting circuit (26) for receiving the gradation voltages respectively corresponding to the j, j+1, k, and k+1 frames interchanging the j+1 frame gradation voltage and the k frame gradation voltage when a first voltage difference between j frame gradation voltage and j+1 frame gradation voltage is less than a second voltage difference between j frame gradation voltage and k frame gradation voltage; a memory circuit (28) for storing the gradation voltages corresponding to the frames 1, 2, . . . j, j+2, . . . k−1, k+1 . . . h and storing the interchanged gradation voltages corresponding to the frames j+1 and k; and a gate driver (21) for receiving the gradation voltages stored in the memory circuit. A smallest rectangular area formed by any two adjacent gate lines together with any two adjacent data lines defines a pixel unit thereat.

17 Claims, 3 Drawing Sheets

LIQUID CRYSTAL DISPLAY HAVING GRADATION VOLTAGE ADJUSTING CIRCUIT AND DRIVING METHOD THEREOF

CROSS-REFERENCE TO RELATED APPLICATION

This application is related to, and claims the benefit of, a foreign priority application filed in Taiwan as Application No. 96,104,972 on Feb. 12, 2007. The related application is incorporated herein by reference.

FIELD OF THE INVENTION

The present invention relates to a liquid crystal display LCD which includes a gradation voltage adjusting circuit, and a method for driving the LCD.

BACKGROUND

Because LCDs have the advantages of portability, low power consumption, and low radiation, they have been widely used in various portable information products such as notebooks, personal digital assistants (PDAs), video cameras, and the like. Furthermore, LCDs are considered by many to have the potential to completely replace CRT (cathode ray tube) monitors and televisions.

FIG. 2 is essentially an abbreviated circuit diagram of a typical LCD 10. The LCD 10 includes a first substrate (not shown), a second substrate (not shown) facing the first substrate, a liquid crystal layer (not shown) sandwiched between the first substrate and the second substrate, a gate driver 11, a data driver 12.

The first substrate includes a number n (where n is a natural number) of gate lines 13 that are parallel to each other and that each extend along a first direction, and a number k (where k is also a natural number) of data lines 14 that are parallel to each other and that each extend along a second direction orthogonal to the first direction. The smallest rectangular area formed by any two adjacent gate lines 13 together with any two adjacent data lines 14 defines a pixel unit (not labeled) thereat. The first substrate also includes a plurality of thin film transistors (TFTs) 15 provided in the vicinity of the intersections of the gate lines 13 and the data lines 14. The first substrate further includes a plurality of pixel electrodes 151 formed on a surface thereof facing the second substrate. The second substrate includes a plurality of common electrodes 152 opposite to the pixel electrodes 151.

In each pixel unit, a gate electrode of the TFT 15 is connected to the corresponding gate line 13, a source electrode of the TFT 15 is connected to the corresponding data line 14, and a drain electrode of the TFT 15 is connected to a corresponding pixel electrode 151. In each pixel unit, the pixel electrode 151, the common electrode 152 and the liquid crystal layer sandwiched therebetween define a capacitor 153.

The gate driver 11 is connected to the gate lines 13 for providing a number of scanning signals to the gate lines 13. The data driver 12 is connected to the data lines 14 for providing a number of gradation voltages to the data lines 14.

FIG. 3 is an abbreviated waveform diagram of driving signals of the LCD 10. The scanning signals G1-Gn are generated by the gate driver 11, and are applied to the gate lines 13. The gradation voltages (Vd) are generated by the data driver 12, and are sequentially applied to the data lines 14. A common voltage Vcom is applied to all the common electrodes 152. Only one scanning signal pulse, e.g., a scanning pulse 19, is applied to each gate line 13 during each single scan. The scanning pulses 19 are output sequentially to the gate lines 13.

In a first frame, the gate driver 11 sequentially provides the scanning pulses 19 (G1 to Gn) to the gate lines 13, and activates the TFTs 15 connected to the gate lines 13. When the gate lines 13 are scanned, the data driver 12 outputs gradation voltages Vd corresponding to image data PD to the data lines 14. Then the gradation voltages Vd are applied to the pixel electrodes 151 via the activated TFTs 15. The potentials of all the common electrodes 152 are set at a uniform potential. The gradation voltages Vd written to the pixel electrodes 151 are used to control the amount of light transmission at the corresponding pixel units and consequently provide an image displayed on the LCD 10. In a second frame, gradation voltages Vd' corresponding to image data PD' are applied to the pixel electrodes 151 via the activated TFTs 15 when the gate lines 13 are scanned by scanning pulses 19'.

In FIG. 3, the gradation voltages Vd are signals whose strength varies in accordance with each piece of image data, whereas the common voltage Vcom has a constant value and does not vary at all.

If motion picture display is conducted on the LCD 10, problems of poor image quality may occur for a variety of reasons. For example, a residual image phenomenon may occur because a response speed of the liquid crystal molecules is too slow. In particular, when a gradation voltage variation occurs, the liquid crystal molecules are unable to track the gradation voltage variation within a single frame period, and instead produce a cumulative response during several frame periods.

It is desired to provide an LCD and a method for driving an LCD which can overcome the above-described deficiencies.

SUMMARY

An exemplary LCD includes a plurality of gate lines that are parallel to each other and that each extend along a first direction; a plurality of data lines that are parallel to each other and that each extend along a second direction different from the first direction, a gradation voltage adjusting circuit, a memory circuit, and a gate driver. A smallest rectangular area formed by any two adjacent gate lines together with any two adjacent data lines defines a pixel unit thereat. The gradation voltage adjusting circuit is configured to receive the gradation voltages respectively corresponding to the j, j+1, k, and k+1 frames, and interchange the j+1 frame gradation voltage and the k frame gradation voltage when a first voltage difference between j frame gradation voltage and j+1 frame gradation voltage is less than a second voltage difference between j frame gradation voltage and k frame gradation voltage. The memory circuit is configured to store the gradation voltages from an external circuit respectively corresponding to the frames 1, 2, . . . j, j+2, . . . k−1, k+1 . . . h, and store the interchanged gradation voltages from the gradation voltage adjusting circuit corresponding to the frames j+1 and k. The gate driver is configured to receive the gradation voltages stored in the memory circuit and sequentially provide the gradation voltages to the data lines.

Other novel features and advantages will become more apparent from the following detailed description when taken in conjunction with the accompanying drawings, in which:

DETAILED DESCRIPTION OF PREFERRED EMBODIMENTS

Reference will now be made to the drawings to describe various embodiments of the present invention in detail.

Figure 1:
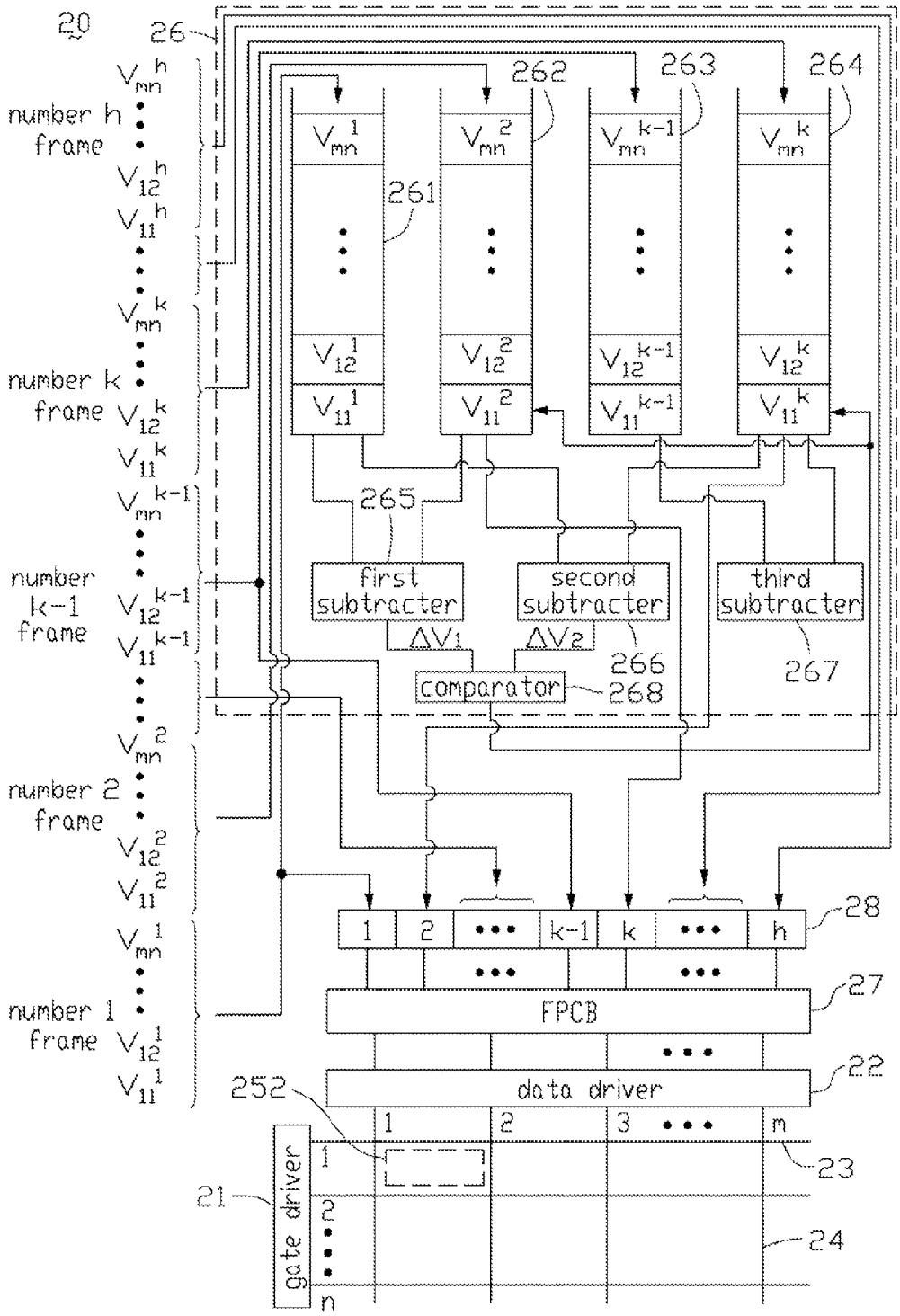
FIG. 1 is essentially an abbreviated circuit diagram of an LCD according to an exemplary embodiment of the present invention.
Figure 2:
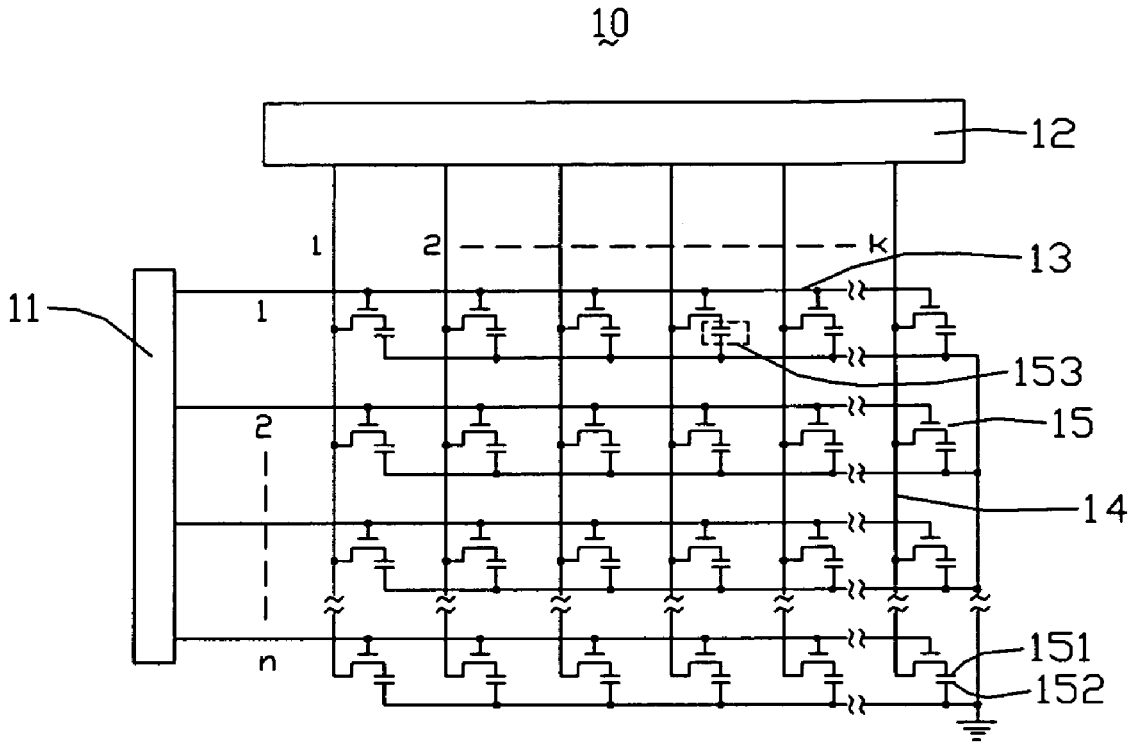
FIG. 2 (RELATED ART)
FIG. 2 is essentially an abbreviated circuit diagram of a conventional LCD.
Figure 3:
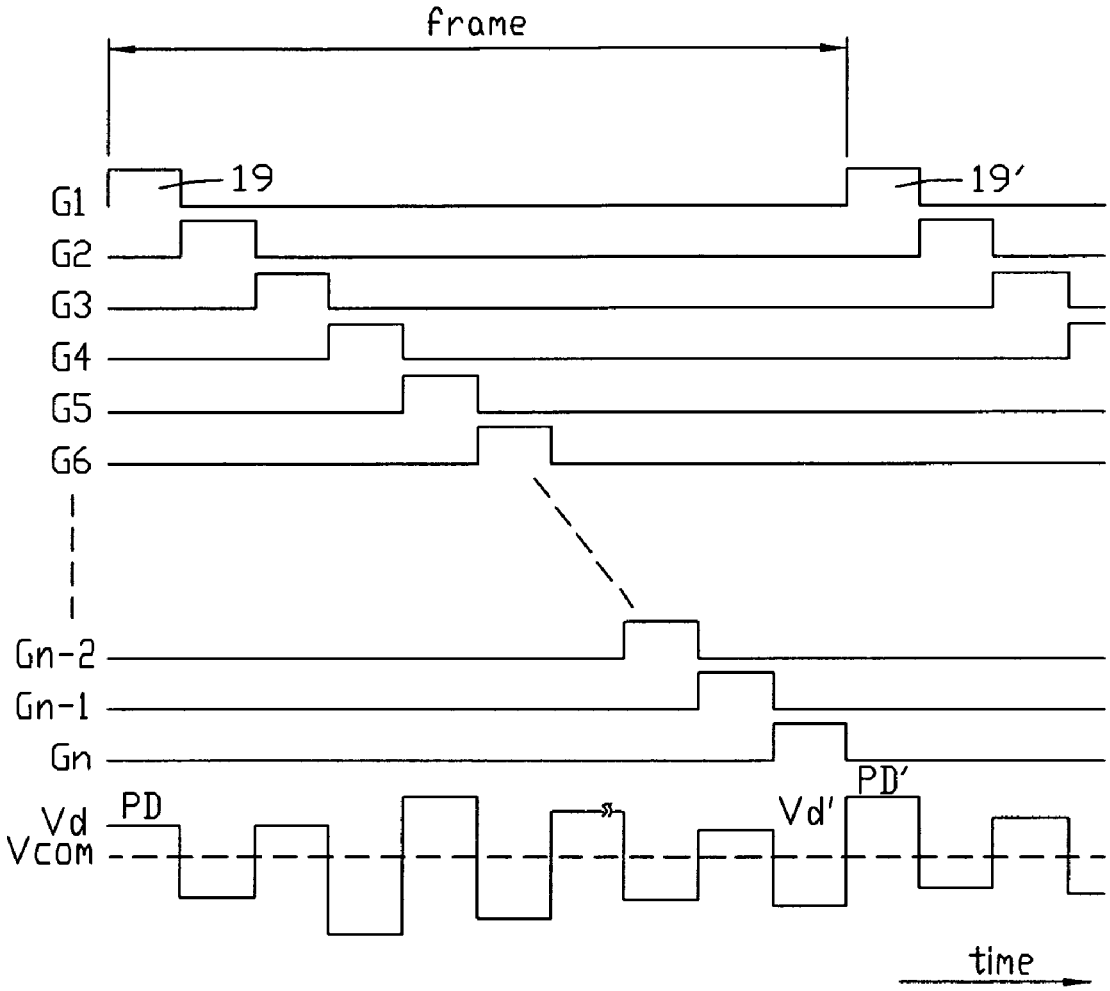
FIG. 3 (RELATED ART)
FIG. 3 is an abbreviated waveform diagram of driving signals of the LCD of FIG. 2.

Referring to FIG. 1, an LCD 20 according to an exemplary embodiment of the present invention is shown. The LCD 20 includes a first substrate (not shown), a second substrate (not shown) facing the first substrate, a liquid crystal layer (not shown) sandwiched between the first substrate and the second substrate, a gate driver 21, a data driver 22, a gradation voltage adjusting circuit 26, a memory circuit 28, a flexible printed circuit board (FPCB) 27, and an external circuit (not shown).

The first substrate includes a number n (where n is a natural number) of gate lines 23 that are parallel to each other and that each extend along a first direction, and a number m (where m is also a natural number) of data lines 24 that are parallel to each other and that each extend along a second direction orthogonal to the first direction. The smallest rectangular area formed by any two adjacent gate lines 23 together with any two adjacent data lines 24 defines a pixel unit 252 thereat. That is, a regular array of pixel units 252 is defined by the intersecting gate lines 23 and data lines 24.

The gate driver 21 is connected to the gate lines 23 for providing a number of scanning signals to the gate lines 23. The data driver 22 is connected to the data lines 24 for providing a number of gradation voltages to the data lines 24.

The external circuit is configured to provide a plurality of gradation voltages respectively corresponding to a number h of frames. The number h is a natural number, and is less than a frame rate (see below). The first gradation voltages corresponding to the number 1 frame are defined as 1 frame gradation voltages ($V_{11}^{1}, V_{12}^{1} \ldots V_{mn}^{1}$). The second gradation voltages corresponding to the number 2 frame are defined as 2 frame gradation voltages ($V_{11}^{2}, V_{12}^{2} \ldots V_{mn}^{2}$), and so on. The gradation voltages corresponding to the number h frame are defined as h frame gradation voltages ($V_{11}^{k}, V_{12}^{k} \ldots V_{mn}^{k}$).

The gradation voltage adjusting circuit 26 sequentially receives the 1 frame gradation voltages, the 2 frame gradation voltages, the k−1 frame ($3 \leqq k \leqq h$, wherein k is a natural number) gradation voltages, and the k frame gradation voltages. Part of the 2 frame gradation voltages and the k frame gradation voltages are adjusted by the gradation voltage adjusting circuit 26, and thereupon provided to the memory circuit 28. The frame rate is the number of the frames that the LCD 20 displays in one second.

The gradation voltage adjusting circuit 26 includes a first stack 261, a second stack 262, a third stack 263, a fourth stack 264, a first subtractor 265, a second subtractor 266, a third subtractor 267, and a comparator 268.

The first stack 261 sequentially receives the 1 frame gradation voltages ($V_{11}^{1}, V_{12}^{1} \ldots V_{mn}^{1}$). The second stack 262 sequentially receives the 2 frame gradation voltages ($V_{11}^{2}, V_{12}^{2} \ldots V_{mn}^{2}$). The third stack 263 sequentially receives the k−1 frame gradation voltages ($V_{11}^{k-1}, V_{12}^{k-1} \ldots V_{mn}^{k-1}$). The fourth stack 264 sequentially receives the k frame gradation voltages ($V_{11}^{k}, V_{12}^{k} \ldots V_{mn}^{k}$).

The first subtractor 265 is configured to calculate first voltage differences ΔV1 between the 1 frame gradation voltages ($V_{11}^{k-1}, V_{12}^{k-1} \ldots V_{mn}^{1}$) and the 2 frame gradation voltages ($V_{11}^{2}, V_{12}^{2} \ldots V_{mn}^{2}$). The second subtractor 266 is configured to calculate second voltage differences ΔV2 between the 1 frame gradation voltages ($V_{11}^{1}, V_{12}^{1} \ldots V_{mn}^{1}$) and the k frame gradation voltages ($V_{11}^{k}, V_{12}^{k} \ldots V_{mn}^{k}$) The third subtractor 267 is configured to calculate third voltage differences between the k−1 frame gradation voltages ($V_{11}^{k-1}, V_{12}^{k-1} \ldots V_{mn}^{k-1}$) and the k frame gradation voltages ($V_{11}^{k}, V_{12}^{k} \ldots V_{mn}^{k}$). The comparator 258 is configured to compare the first voltage difference ΔV1 with the second voltage difference ΔV2.

The memory circuit 28 is configured to store the gradation voltages corresponding to the number 1, 2 . . . k frames, wherein part of the 2 frame gradation voltages ($V_{11}^{2}, V_{12}^{2} \ldots V_{mn}^{2}$) and part of the k frame gradation voltages ($V_{11}^{k}, V_{12}^{k} \ldots V_{mn}^{k}$) are adjusted according to calculating and comparing results of the first, second, and third subtractors 265, 266, 267 and the comparator 268. The adjusted gradation voltages corresponding to the number 1, 2, . . . k frames are provided to the data driver 22 via the FPCB 27. The memory circuit 28 includes a number k of memory units for storing the gradation voltages.

An exemplary method for driving the LCD 20 is described in detail as follows. The external circuit provides the gradation voltages corresponding to the number 1, 3, . . . k−1, k+1, k+2 . . . h frames to the number 1, 3, . . . k−1, k+1, k+2, . . . h memory units of the memory circuit 28. At the same time, the external circuit provides the 1 frame gradation voltages, the 2 frame gradation voltages, the k−1 frame gradation voltages, and the k frame gradation voltages to the first, second, third and fourth stacks 261, 262, 263, 264 respectively.

The first subtractor 265 sequentially receives the 1 frame gradation voltages ($V_{11}^{1}, V_{12}^{1} \ldots V_{mn}^{1}$) from the first stack 261 and the 2 frame gradation voltages ($V_{11}^{2}, V_{12}^{2} \ldots V_{mn}^{2}$) from the second stack 262, and sequentially generates a number of first voltage differences ΔV1 according to the received 1 frame gradation voltages and 2 frame gradation voltages. The second subtractor 266 sequentially receives the 1 frame gradation voltages ($V_{11}^{1}, V_{12}^{1} \ldots V_{mn}^{1}$) from the first stack 261 and the k frame gradation voltages ($V_{11}^{k}, V_{12}^{k} \ldots V_{mn}^{k}$) from the fourth stack 268, and sequentially generates a number of second voltage differences ΔV2 according to the received 1 frame gradation voltages and k frame gradation voltages. The subtractor 267 sequentially receives the k−1 frame gradation voltages ($V_{11}^{k-1}, V_{12}^{k-1} \ldots V_{mn}^{k-1}$) from the third stack 263 and the k frame gradation voltages ($V_{11}^{k}, V_{12}^{k} \ldots V_{mn}^{k}$) from the fourth stack 264, and sequentially generates a number of third voltage differences according to k−1 frame gradation voltages and k frame gradation voltages.

The comparator 268 sequentially receives and compares the first voltage differences ΔV1 and the second voltage differences ΔV2 received from the first subtractor 265 and the second subtractor 266 respectively. When the first voltage differences ΔV1 are greater than zero and the second voltage differences ΔV2 are equal to zero, a first image corresponding to the 2 frame gradation voltages is defined as a motion picture and a second image corresponding to the k frame gradation voltages is defined as a still picture. If a first voltage difference ΔV1 of a pixel unit 252 is less than a second voltage difference ΔV2 of the pixel unit 252, the 2 frame gradation voltages and the k frame gradation voltages provided to the pixel unit 252 are interchanged. Thus the k frame gradation voltages stored in the fourth stack 264 are provided to the number 2 memory unit of the memory circuit 28, and the 2 frame gradation voltages stored in the second stack 262 are provided to the number k memory unit of the memory circuit 28. Otherwise, the 2 frame gradation voltages from the external circuit are stored in the number 2 memory unit.

For example, if the 2 frame gradation voltages and the k frame gradation voltages provided to a pixel unit 252 in a first row and a first column are interchanged, the adjusted gradation voltages stored in the number 2 unit of the memory circuit 28 are arranged in the order $V_{11}^{k}, V_{12}^{2}, V_{13}^{2}, \ldots, V_{mn}^{2}$, and the adjusted gradation voltages stored in the number k unit of the memory circuit 28 are arranged in the order $V_{11}^{2}, V_{12}^{k}, V_{13}^{k}, \ldots, V_{mn}^{k}$. Otherwise, when the 2 frame gradation voltages and the k frame gradation voltages provided to the pixel unit 252 need not be exchanged, the gradation voltages stored in the number 2 unit of the memory circuit 28 are arranged in the order $V_{11}^{2}, V_{12}^{2}, V_{13}^{2}, \ldots, V_{mn}^{2}$, and the gradation voltages stored in the number k unit of the memory circuit 28 are arranged in the order $V_{11}^{k}, V_{12}^{k}, V_{13}^{k}, \ldots, V_{mn}^{k}$.

In a first frame, the number 1 unit of the memory circuit 28 provides a first part ($V_{11}^{1}, V_{12}^{1} \ldots V_{1n}^{1}$) of the 1 frame gradation voltages corresponding to the pixel units 252 arranged in a first row of the array to the data driver 22 via the FPCB 27. When a first one of the gate lines 23 is scanned, the data driver 22 outputs the first part of the 1 frame gradation voltages ($V_{11}^{1}, V_{12}^{1} \ldots V_{1n}^{1}$) to the data lines 24. Then, the number 1 unit of the memory circuit 28 provides a second part ($V_{21}^{1}, V_{22}^{1} \ldots V_{2n}^{1}$) of the 1 frame gradation voltages corresponding to the pixel units 252 arranged in a second row of the array to the data driver 22 via the FPCB 27. When a second one of the gate lines 23 is scanned, the data driver 22 outputs the second part of the 1 frame gradation voltages ($V_{21}^{1}, V_{22}^{1} \ldots V_{2n}^{1}$) to the data lines 24. A process similar to the above continues until, finally, the number 1 unit of the memory circuit 28 provides a last part of the 1 frame gradation voltages ($V_{m1}^{1}, V_{m2}^{1} \ldots V_{mn}^{1}$) corresponding to the pixel units 252 arranged in a number nth row of the array to the data driver 22 via the FPCB 27. When the number n gate line 23 is scanned, the data driver 22 outputs the last part of the 1 frame gradation voltages ($V_{m1}^{1}, V_{m2}^{1} \ldots V_{mn}^{1}$) to the data lines 24.

In a second frame and subsequent frames, the LCD 20 works in similar fashion to that described above. Thus the number 2 unit of the memory circuit 28 sequentially provides interchanged 2 frame gradation voltages ($V_{11}^{k}, V_{12}^{2}, V_{13}^{2}, \ldots, V_{mn}^{2}$) to the data driver 22 via the FPCB 27. When the gate lines 23 are sequentially scanned, the data driver 22 outputs the interchanged 2 frame gradation voltages ($V_{11}^{k}, V_{12}^{2}, V_{13}^{2}, \ldots, V_{mn}^{2}$) to the data lines 24, and so on.

In an alternative embodiment of the present invention, the gradation voltage adjusting circuit 26 receives the j (wherein j is a natural number and j<k) frame gradation voltages, the j+1 frame gradation voltages, the k−1 frame gradation voltages, and the k frame gradation voltages. Part of the j+1 frame gradation voltages and part of the k frame gradation voltages are adjusted by the gradation voltage adjusting circuit 26 and thereupon provided to the memory circuit 28.

The first stack 261 sequentially receives the j frame gradation voltages ($V_{11}^{j}, V_{12}^{j} \ldots V_{mn}^{j}$). The second stack 262 sequentially receives the j+1 frame gradation voltages ($V_{11}^{j+1}, V_{12}^{j+1} \ldots V_{mn}^{j+1}$). The third stack 263 sequentially receives the k−1 frame gradation voltages ($V_{11}^{k-1}, V_{12}^{k-1} \ldots V_{mn}^{k-1}$). The fourth stack 264 sequentially receives the k frame gradation voltages ($V_{11}^{k}, V_{12}^{k} \ldots V_{mn}^{k}$.

The first subtractor 265 is configured to calculate first voltage differences ΔV1 between the j frame gradation voltages ($V_{11}^{j}, V_{12}^{j} \ldots V_{mn}^{j}$) and the j+1 frame gradation voltages ($V_{11}^{j+1}, V_{12}^{j+1} \ldots V_{mn}^{j+1}$). The second subtractor 266 is configured to calculate second voltage differences ΔV2 between the j frame gradation voltages ($V_{11}^{j}, V_{12}^{j} \ldots V_{mn}^{j}$) and the k frame gradation voltages ($V_{11}^{k}, V_{12}^{k} \ldots V_{mn}^{k}$). The third subtractor 267 is configured to calculate third voltage differences between the k−1 frame gradation voltages ($V_{11}^{k-1}, V_{12}^{k-1} \ldots V_{mn}^{k-1}$) and the k frame gradation voltages ($V_{11}^{k}, V_{12}^{k} \ldots V_{mn}^{k}$). The comparator 258 is configured to compare the first voltage differences ΔV2 with the second voltage differences ΔV2.

The memory circuit 28 is configured to store the gradation voltages corresponding to the number 1, 2, . . . h frames, wherein part of the j+1 frame gradation voltages ($V_{11}^{j+1}, V_{12}^{j+1} \ldots V_{mn}^{j+1}$) and part of the k frame gradation voltages ($V_{11}^{k}, V_{12}^{k} \ldots V_{mn}^{k}$) are adjusted according to the calculating and comparing results of the first, second, and third subtractors 265, 266, 267 and thecomparator 268. Thereby, the adjusted gradation voltages corresponding to the number 1, 2, . . . k frames are provided to the data driver 22 via the FPCB 27.

In a driving method according to the alternative embodiment of the present invention, the external circuit provides the gradation voltages corresponding to the number 1, 2, . . . j, j+1, j+2 . . . k−1, k+1, k+2 . . . h frames to be stored into the memory circuit 28 in one second. At the same time, the external circuit provides the j frame gradation voltages, the j+1 frame gradation voltages, the k−1 frame gradation voltages, and the k frame gradation voltages to store in the first, second, third and fourth stacks 261, 262, 263, 264 respectively.

The first subtractor 265 sequentially receives the j frame gradation voltages ($V_{11}^{j}, V_{12}^{j} \ldots V_{mn}^{j}$) from the first stack 261 and the j+1 frame gradation voltages ($V_{11}^{j+1}, V_{12}^{j+1} \ldots V_{mn}^{j+1}$) from the second stack 262, and sequentially generates a number of first voltage differences ΔV1 according to the received j frame gradation voltages and j+1 frame gradation voltages. The second subtractor 266 sequentially receives the j frame gradation voltages ($V_{11}^{j}, V_{12}^{j} \ldots V_{mn}^{j}$) from the first stack 261 and the k frame gradation voltages ($V_{11}^{k}, V_{12}^{k} \ldots V_{mn}^{k}$) from the fourth stack 268, and sequentially generates a number of second voltage differences ΔV2 according to the received j frame gradation voltages and k frame gradation voltages. The third subtractor 267 sequentially receives the k−1 frame gradation voltages ($V_{11}^{k-1}, V_{12}^{k-1} \ldots V_{mn}^{k-1}$) from the third stack 263 and the k frame gradation voltages ($V_{11}^{k}, V_{12}^{k} \ldots V_{mn}^{k}$) from the fourth stack 264, and sequentially generates a number of third voltage differences according to the received k−1 frame gradation voltages and k frame gradation voltages.

The comparator 268 sequentially receives and compares the first voltage differences ΔV1 and the second voltage differencesΔV2 . When the first voltage differences ΔV1 are greater than zero and the second voltage differences ΔV2 are equal to zero, a first image corresponding to the j+1 frame gradation voltages is defined as a motion picture and a second image corresponding to the k frame gradation voltages is defined as a still picture. If a first voltage difference ΔV1 of a pixel unit 252 is less than a second voltage difference ΔV2 of the pixel unit 252, the j+1 frame gradation voltages and the k frame gradation voltages provided to the pixel unit 252 are interchanged. Thus the k frame gradation voltages stored in the fourth stack 264 are provided to the number j+1 memory unit of the memory circuit 28, and the j+1 frame gradation voltages stored in the second stack 262 are provided to the number k memory unit of the memory circuit 28. Otherwise, the j+1 frame gradation voltages from the external circuit are stored in the number j+1 memory unit, and the k frame gradation voltages from the external circuit are stored in the number k memory unit.

For example, if the j+1 frame gradation voltages and the k frame gradation voltages provided to one pixel unit 252 in the first row and the first column are exchanged, the adjusted gradation voltages stored in the number 2 unit of the memory circuit 28 are arranged in the order $V_{11}^{k}, V_{12}^{j+1}, V_{13}^{j+1}, \ldots, V_{mn}^{j+1}$, and the adjusted gradation voltages stored in the number k unit of the memory circuit 28 are arranged in the order $V_{11}^{j+1}, V_{12}^{k}, V_{13}^{k}, \ldots, V_{mn}^{k}$. Otherwise, when the j+1 frame gradation voltages and the k frame gradation voltages provided to a pixel unit 252 need not be exchanged, the gradation voltages stored in the number 2 unit of the memory circuit 28 are arranged in the order $V_{11}^{j+1}, V_{12}^{j+1}, V_{13}^{j+1}, \ldots, V_{mn}^{j+1}$, and the gradation voltages stored in the number k unit of the memory circuit 28 are arranged in the order $V_{11}^{k}, V_{12}^{k}, V_{13}^{k}, \ldots, V_{mn}^{k}$.

In a first frame, the number j unit of the memory circuit 28 provides a first part of the j frame gradation voltages ($V_{11}^{j}, V_{12}^{j} \ldots V_{1n}^{j}$) corresponding to the pixel units 252 arranged in the first row of the array to the data driver 22 via the FPCB 27. When the first gate line 23 is thus scanned, the data driver 22 outputs the first part of the j frame gradation voltages ($V_{11}^{j}, V_{12}^{j} \ldots V_{1n}^{j}$) to the data lines 24. Then, the number j unit of the memory circuit 28 provides the second part of the j frame gradation voltages ($V_{21}^{j}, V_{22}^{j} \ldots V_{2n}^{j}$) corresponding to the pixel units 252 arranged in the second row of the array to the data driver 22 via the FPCB 27. When a second gate line 23 is thus scanned, the data driver 22 outputs the second part of the j frame gradation voltages ($V_{21}^{j}, V_{22}^{j} \ldots V_{2n}^{j}$) to the data lines 24. Finally, the number j unit of the memory circuit 28 provides the last part of the j frame gradation voltages ($V_{m1}^{j}, V_{m2}^{j} \ldots V_{mn}^{j}$) corresponding to the, pixel units 252 arranged in the number n row to the data driver 22 via the FPCB 27. When the number n gate line 23 is thus scanned, the data driver 22 outputs the last part of the j frame gradation voltages ($V_{m1}^{j}, V_{m2}^{j} \ldots V_{mn}^{j}$) to the data lines 24.

In a second frame and subsequent frames, the operation of the LCD 20 is similar to that described above. The number 2 unit of the memory circuit 28 sequentially provides interchanged j+1 frame gradation voltages ($V_{11}^{k}, V_{12}^{j+1}, V_{13}^{j+1} \ldots V_{21}^{j+1}, V_{22}^{k}, V_{23}^{j+1} \ldots V_{mn}^{j+1}$) to the data driver 22 via the FPCB 27. When the gate lines 23 are thus scanned, the data driver 22 sequentially outputs j+1 interchanged frame gradation voltages ($V_{11}^{k}, V_{12}^{j+1}, V_{13}^{j+1} \ldots V_{21}^{j+1}, V_{22}^{k}, V_{23}^{j+1} \ldots V_{mn}^{j+1}$) to the data lines 24, and so on.

Because the LCD 20 includes the gradation voltage adjusting circuit 26 for interchanging the voltages provided to each pixel unit 252 respectively corresponding to the number j+1 frame and the number k frame, the voltage difference of a pixel unit 252 between the number j and number j+1 frames is increased. Thus a response speed of liquid crystal molecules of the pixel unit 252 is increased, and the liquid crystal molecules are able to timely track the gradation variation from the frame j to the frame j+1. Therefore, a residual image phenomenon of the LCD 20 can be reduced or even eliminated altogether.

In a further embodiment, when the first voltage differences $\Delta V1$ are in the range from 1-4 gradations, the first image corresponding to the gradation voltages of the number j+1 frame is defined as a motion picture.

It is to be further understood that even though numerous characteristics and advantages of exemplary and preferred embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid crystal display (LCD), comprising:

a plurality of gate lines that are parallel to each other and that each extend along a first direction;

a plurality of data lines that are parallel to each other and that each extend along a second direction different from the first direction, a smallest rectangular area formed by any two adjacent gate lines together with any two adjacent data lines defining a pixel unit thereat;

a gradation voltage adjusting circuit configured to receive gradation voltages from an external circuit, the gradation voltages respectively corresponding to j, j+1, k−1, and k frames, and interchange a j+1 frame gradation voltage and a k frame gradation voltage when a first voltage difference between the j frame gradation voltage and the j+1 frame gradation voltage is less than a second voltage difference between the j frame gradation voltage and a k frame gradation voltage;

a memory circuit configured to store the gradation voltages received from the external circuit, wherein when the first voltage difference is less than the second voltage difference, the memory stores the gradation voltages corresponding to frames 1, 2, . . . j, j+2, . . . k−1, k+1 . . . h, and the interchanged gradation voltages corresponding to the frames j+1 and k from the gradation voltage adjusting circuit;

a gate driver configured for scanning the gate lines; and a data driver configured to receive the gradation voltages stored in the memory circuit and sequentially provide the gradation voltages to the data lines;

wherein j, k and h are natural numbers.

2. The LCD as claimed in claim 1, wherein the gradation voltage adjusting circuit comprises a first stack, a second stack, a third stack, and a fourth stack, the first stack sequentially configured for receiving the j frame gradation voltage, the second stack configured for sequentially receiving the j+1 frame gradation voltage, the third stack configured for sequentially receiving the k−1 frame gradation voltage, and the fourth stack configured for sequentially receiving the k frame gradation voltage.

3. The LCD as claimed in claim 1, wherein the gradation voltage adjusting circuit further comprises a first subtractor, a second subtractor and a third subtractor, the first subtractor configured for calculating the first voltage difference between the j frame gradation voltage and the j+1 frame gradation voltage, the second subtractor configured for calculating the second voltage difference between the j frame gradation voltage and the k frame gradation voltage, and the third subtractor configured for calculating a third voltage difference between the k−1 frame gradation voltage and the k frame gradation voltage.

4. The LCD as claimed in claim 3, the gradation voltage adjusting circuit further comprises a comparator, the comparator configured for comparing the first voltage difference with the second voltage difference.

5. The LCD as claimed in claim 1, wherein the memory circuit comprises a plurality of memory units 1, 2, . . . j, j+1, j+2, . . . k−1, k, k+1 . . . h for respectively storing the gradation voltages corresponding to 1, 2, . . . j, j+1, j+2, . . . k−1, k, k+1 . . . h frames images displaying on the LCD in a second.

6. The LCD as claimed in claim 1, wherein the number j is equal to 1.

7. The LCD as claimed in claim 1, further comprising a flexible printed circuit board (FPCB) connected between the gradation voltage adjusting circuit and the gate driver.

8. The LCD as claimed in claim 1, wherein when the first voltage differences are in the range from 1-4 gradations, and a first image corresponding to gradation voltages of the number j+1 frame is defined as a motion picture.

9. A driving method of a liquid crystal display (LCD), the LCD comprising a plurality of gate lines, a plurality of data lines, a memory circuit, a gradation voltage adjusting circuit, a gate driver, and a data driver, the driving method comprising:

storing gradation voltages corresponding to 1, 2, . . . j, j+1, j+2, . . . k−1, k, k+1 . . . h frames in the memory circuit;

providing gradation voltages respectively corresponding to the j, j+1, k−1, and k frames to the gradation voltage adjusting circuit;

interchanging gradation voltages corresponding to the j+1 and k frames when a first voltage difference between the j frame gradation voltage with the j+1frame gradation voltage is less than a second voltage difference between the j frame gradation voltage and a k frame gradation voltage;

storing the interchanged gradation voltages corresponding to the j+1 and k frames in the memory circuit, and the gradation voltages corresponding to frames 1, 2, . . . j, j+2, . . . k−1, k+1 . . . h; and transmitting the gradation voltages stored in the memory circuit to the data driver;

wherein j, k and h are natural numbers.

10. The driving method as claimed in claim 9, wherein the memory circuit comprises a plurality of memory units 1, 2, . . . j, j+1, . . . k−1, k, k+1, . . . h for respectively storing the gradation voltages corresponding to 1, 2, . . . j, j+1, j+2, . . . k−1, k, k+1, . . . h frames images displaying on the LCD in one second.

11. The driving method as claimed in claim 10, wherein the k frame gradation voltages are stored in the number j+1 memory unit of the memory circuit, and the j+1 frame gradation voltages are stored in the number k memory unit of the memory circuit.

12. The driving method as claimed in claim 11, wherein the gradation voltages corresponding to pixel units in a row are provided to the data driver each time.

13. The driving method as claimed in claim 9, further comprising a step of scanning the gate lines by the gate driver.

14. The driving method as claimed in claim 13, further comprising a step of sequentially providing the gradation voltages to data lines by the data driver when the gate lines are scanned.

15. The driving method as claimed in as claimed in claim 9, wherein the number j is equal to 1.

16. The driving method as claimed in claim 9, further comprising a step of providing a flexible printed circuit board (FPCB) connected between the gradation voltage adjusting circuit and the gate driver.

17. The driving method as claimed in claim 9, wherein when the first voltage differences are in the range from 1-4 gradations, a first image corresponding to the gradation voltages of the number j+1 frame is defined as a motion picture.

* * * * *

UNITED STATES PATENT AND TRADEMARK OFFICE

CERTIFICATE OF CORRECTION

PATENT NO. : 7,990,354 B2
APPLICATION NO. : 12/069922
DATED : August 2, 2011
INVENTOR(S) : Chih-Sheng Chang and Chueh-Ju Chen It is certified that error appears in the above-identified patent and that said Letters Patent is hereby corrected as shown below:

Please replace Item (73) regarding "Assignees" on the front page of the Patent with the following:

-- (73) Assignees: Chimei Innolux Corporation, Miao-Li County (TW). --

Signed and Sealed this
Thirty-first Day of January, 2012

David J. Kappos

David J. Kappos
*Director of the United States Patent and Trademark Office*